US011454369B2

(12) United States Patent
Calavia et al.

(10) Patent No.: US 11,454,369 B2
(45) Date of Patent: Sep. 27, 2022

(54) AUTOMOTIVE LIGHTING DEVICE

(71) Applicant: VALEO VISION, Bobigny (FR)

(72) Inventors: Antonio Calavia, Bobigny (FR); Juan Eugenio Valdivielso, Bobigny (FR); Macarena Bueno, Bobigny (FR); Carlos Gomez Ruiz, Bobigny (FR); Mari-Angeles Barragan, Bobigny (FR); Jesus Tallon, Bobigny (FR)

(73) Assignee: VALEO VISION, Bobigny (FR)

( * ) Notice: Subject to any disclaimer, the term of this patent is extended or adjusted under 35 U.S.C. 154(b) by 0 days.

(21) Appl. No.: 17/289,530

(22) PCT Filed: Oct. 25, 2019

(86) PCT No.: PCT/EP2019/079259
§ 371 (c)(1),
(2) Date: Apr. 28, 2021

(87) PCT Pub. No.: WO2020/089108
PCT Pub. Date: May 7, 2020

(65) Prior Publication Data

US 2022/0018514 A1 Jan. 20, 2022

(30) Foreign Application Priority Data

Oct. 31, 2018 (EP) ..... 18382774

(51) Int. Cl.
*F21S 43/237* (2018.01)
*F21S 43/249* (2018.01)
*F21S 43/14* (2018.01)

(52) U.S. Cl.
CPC ..... *F21S 43/237* (2018.01); *F21S 43/14* (2018.01); *F21S 43/249* (2018.01)

(58) Field of Classification Search
CPC ... B60Q 1/0011; G02B 6/0006; G02B 6/0008
See application file for complete search history.

(56) References Cited

U.S. PATENT DOCUMENTS 6,520,666 B1 * 2/2003 Beyerlein ..... F21V 13/02 362/471
2005/0052883 A1 * 3/2005 Qi ..... G09F 9/305 362/555

(Continued)

FOREIGN PATENT DOCUMENTS

EP 1 677 045 A2 7/2006
EP 2 163 809 A2 3/2010
EP 3 045 801 A1 7/2016

OTHER PUBLICATIONS

International Search Report dated Feb. 5, 2020 in PCT/EP2019/079259 filed on Oct. 25, 2019.

*Primary Examiner* — Eric T Eide
(74) *Attorney, Agent, or Firm* — Oblon, McClelland, Maier & Neustadt, L.L.P.

(57) ABSTRACT

This invention provides an automotive lighting device (1) comprising a plurality of solid-state light sources (2) and a light guide (4). The solid-state light sources (2) are configured to emit light according to a light direction (d), each one having a light source centre (20) and each one defining a light source plane (21), which is a plane perpendicular to the light direction (d) which contains the corresponding light source centre (20). The light guide (4) has a reception inlet (40) which projects an optical profile (41) on the closest light source plane (21) according to the light direction (d), the optical profile (41) having an optical centre (42). The light sources (2) are arranged to project light beams to the reception inlet (40) of the light guide (4) in such a way that at least 70% of the light source centres (20) are closer to the optical profile (41) than to the optical centre (42).

20 Claims, 2 Drawing Sheets

(56) References Cited

U.S. PATENT DOCUMENTS

| | | | | |
|---|---|---|---|---|
| 2005/0152141 | A1 | 7/2005 | Suzuki | |
| 2006/0147151 | A1 | 7/2006 | Wanninger et al. | |
| 2007/0053203 | A1* | 3/2007 | Graham | G02B 6/0008 362/559 |
| 2008/0285301 | A1 | 11/2008 | Wanninger et al. | |
| 2010/0067226 | A1 | 3/2010 | Higuchi et al. | |
| 2010/0246200 | A1 | 9/2010 | Tessnow et al. | |
| 2016/0121782 | A1* | 5/2016 | Soenen | F21S 43/249 362/511 |
| 2016/0207450 | A1 | 7/2016 | Fuentes et al. | |
| 2017/0198879 | A1 | 7/2017 | Martinez-Perez et al. | |
| 2017/0234501 | A1* | 8/2017 | Hanami | G02B 6/0036 362/511 |
| 2019/0048541 | A1* | 2/2019 | Lee | E01F 9/20 |
| 2019/0309923 | A1* | 10/2019 | Schall | F21S 43/27 |

* cited by examiner

AUTOMOTIVE LIGHTING DEVICE

TECHNICAL FIELD

This invention is related to the field of light sources comprised in automotive lighting devices, and more particularly, with their grouping arrangement.

STATE OF THE ART

Some lighting functionalities make use of a group of light sources to provide a flux high enough to fulfil the lighting requirements.

Some light sources, such as LEDs, generate a great amount of heat during their operation. This heat is related with the current that passes through them and may involve serious damage to the light source if not properly dissipated.

As a consequence, current is usually chosen so that the heat produced by the light sources is not so high that cannot be dissipated.

This problem is particularly serious when a big amount of light sources is demanded to provide a flux high enough in a small portion of the lighting device.

A solution to the aforementioned problem is therefore sought.

DESCRIPTION OF THE INVENTION

The invention provides a solution for improving the above mentioned drawbacks by an automotive lighting device according to the present disclosure. Preferred embodiments of the invention are defined herein.

Unless otherwise defined, all terms (including technical and scientific terms) used herein are to be interpreted as is customary in the art. It will be further understood that terms in common usage should also be interpreted as is customary in the relevant art and not in an idealised or overly formal sense unless expressly so defined herein.

In this text, the term "comprises" and its derivations (such as "comprising", etc.) should not be understood in an excluding sense, that is, these terms should not be interpreted as excluding the possibility that what is described and defined may include further elements, steps, etc.

In a first inventive aspect, the invention provides an automotive lighting device comprising

- a plurality of solid-state light sources configured to emit light according to a light direction, each one having a light source centre and each one defining a light source plane, which is a plane perpendicular to the light direction which contains the corresponding light source centre; and
- a light guide with a reception inlet which projects an optical profile on the closest light source plane according to the light direction, the optical profile having an optical centre; wherein the light sources are arranged to project light beams to the reception inlet of the light guide in such a way that at least 70% of the centres of the light sources are closer to the optical profile than to the optical centre.

The term "solid state" refers to light emitted by solid-state electroluminescence, which uses semiconductors to convert electricity into light. Compared to incandescent lighting, solid state lighting creates visible light with reduced heat generation and less energy dissipation. The typically small mass of a solid-state electronic lighting device provides for greater resistance to shock and vibration compared to brittle glass tubes/bulbs and long, thin filament wires. They also eliminate filament evaporation, potentially increasing the life span of the illumination device. Some examples of these types of lighting comprise semiconductor light-emitting diodes (LEDs), organic light-emitting diodes (OLED), or polymer light-emitting diodes (PLED) as sources of illumination rather than electrical filaments, plasma or gas.

This automotive lighting device comprises a plurality of solid-state light sources which are arranged closest to the periphery of the optical profile than to the centre, thus generating some additional space between them, which is greater than the minimum distance which is recommended by the light source manufacturer. This distance is important because it allows a better heat dissipation, so that the light source may be fed by a greater current and therefore provide a more powerful flux without being damaged by generated heat.

For the purpose of the invention, the term "centre" is considered as the geometric centre of the light source. Light sources are usually enclosed in parallelepiped cases, so the centre is very easy to define for the person skilled in the art. In the event the case has not a regular geometry, the centre of mass of the corresponding case will be considered as the centre of the light source.

This invention is particularly advantageous when the optical element is a light guide, since a light guide usually has a relatively small cross section and requires a high flux to perform the lighting functionalities, so the plurality of light sources are usually very close to each other in the lighting devices known in the state of the art, trying to obtain the greater density possible of light sources per surface.

In some particular embodiments, at least 80% of the centres of the light sources are closer to the optical profile than to the optical centre.

The higher the proportion of light sources closest to the periphery, the higher additional space is created between them.

According to the invention, the light guide can for example have the shape of a rod, the rod having a first extremity comprising and/or forming the reception inlet. The invention is particularly useful in such a case, wherein the optical profile is narrow as the optical profile size is substantially the same as the section of the rod. The light source centres being arranged in the optical profile, it enable good heat dissipation despite the small space in which the plurality of light sources are arranged.

According to the invention, the light guide can for example be a circular light guide and said optical profile is a circle, the centre of which being the optical centre.

In some particular embodiments, the light guide comprises a circular section defining a light guide radius.

Circular light guides are very common in automotive applications, and this invention is particularly adapted to this shape.

In some particular embodiments, at least the 70% of the light source centres are contained in a circular crown defined by a greater radius and a lower radius, the circular crown being notably inside the profile. For example, the lower radius is at least 80% of the greater radius and the greater radius is at least 80% of the light guide radius.

When a circular light guide is used, an advantageous arrangement include most of the light sources in a circular crown which is close to the periphery of the light guide, where there is a greater area and the light sources may have additional space between them, so that the thermal behaviour is improved.

For example, the light sources which have their light source centres contained in the circular crown are arranged such that the shortest distance between the closest sides of adjacent light source in the crown is less than the size of the sides of the corresponding light source. It corresponds to an arrangement in a narrow optical profile but this arrangement is thermally optimized as the majority of light sources are arranged in the periphery of the optical profile.

According to the invention, one of the light sources can be central. This enables to have more light sources cooperating with the reception inlet, especially in the case of the arrangement of the other light sources close to the periphery. For example, the optical centre of this central light source can be arranged on the optical centre of the optical profile.

In some particular embodiments, the light source comprises a case which has a case surface between 1 $mm^2$ and 3 $mm^2$ the distance between the two closest light source centres is greater than 1.25 times the square root of the case surface of the light sources comprising these two closest light source centres.

In these embodiments, a particular additional space is ensured.

In some particular embodiments, the light cases comprise straight sides, and the sides of the light cases of at least one pair of light sources are not parallel.

The fact that the orientations are different also contributes in generating more additional space between the light sources.

In some particular embodiments, each light source has a total copper area around it which is greater than 3 times the case surface, wherein the copper area may be divided into several copper area portions.

Light sources are arranged in such a way that the additional space creates a copper area high enough. The copper area is key for a proper dissipation of the heat which is generated in the light source. Increasing this copper area makes that more heat is dissipated, thus improving the working conditions of the light source.

In some particular embodiments, the light sources are located in a plane surface, so that the light source centres are arranged in the same plane.

The light emission of the solid-state light sources is more controlled when all of them are placed in a plane support, such as a plane printed circuit board.

In some particular embodiments, the light sources perform at least one of a turning indicator or a day running light.

These particular examples employ a guide light for performing the lighting functionality. As a consequence, they are particularly suitable for this invention.

BRIEF DESCRIPTION OF THE DRAWINGS

To complete the description and in order to provide for a better understanding of the invention, a set of drawings is provided. Said drawings form an integral part of the description and illustrate an embodiment of the invention, which should not be interpreted as restricting the scope of the invention, but just as an example of how the invention can be carried out. The drawings comprise the following figures.

DETAILED DESCRIPTION OF THE INVENTION

Figure 1:
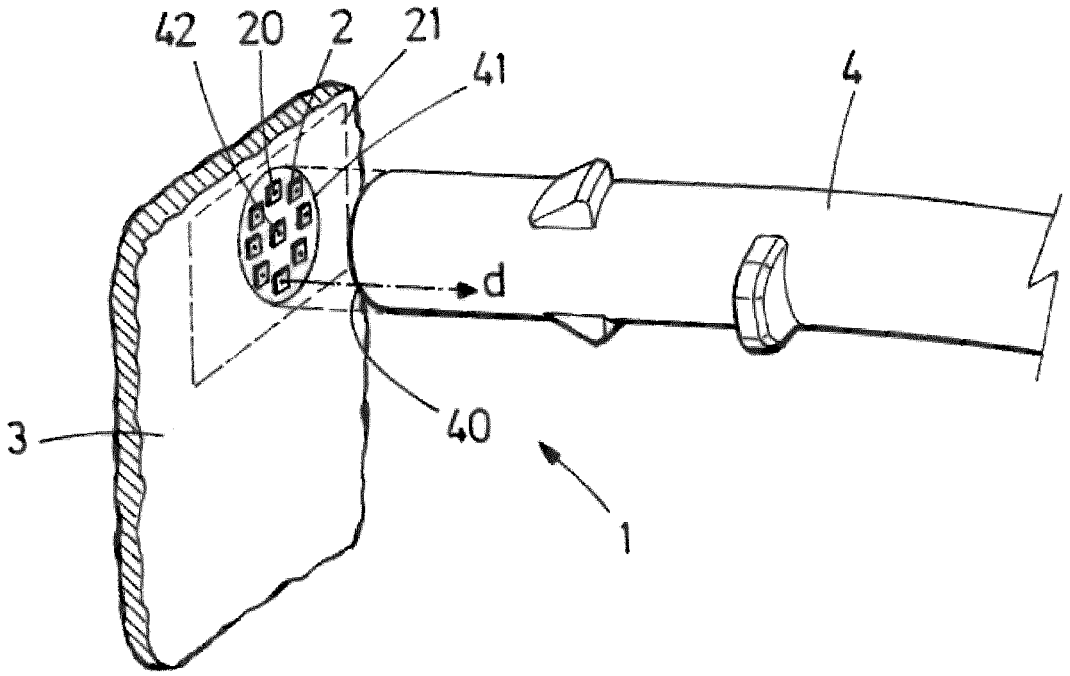
FIG. 1 shows a perspective view of a particular example of part of an automotive lighting device according to the invention.

The example embodiments are described in sufficient detail to enable those of ordinary skill in the art to embody and implement the systems and processes herein described. It is important to understand that embodiments can be provided in many alternate forms and should not be construed as limited to the examples set forth herein.

Accordingly, while embodiment can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

FIG. 1 shows a perspective view of a particular example of part of an automotive lighting device 1 according to the invention.

This lighting device 1 comprises a plurality of LEDs 2 configured to emit light according to a light direction d. Each LED 2 has a LED centre 20, which is considered as the geometric centre of the LED structure. In the particular embodiment shown in this figure, the LEDs 2 are located in a plane printed circuit board 3, so that the LED centres 20 are arranged in the same plane 21. This plane 21 is perpendicular to the light direction d, since all the LEDs emit light in the same direction.

This lighting device 1 also comprises a light guide 4 with a reception inlet 40 which projects an optical profile 41 on the plane 21 containing the LED centres 20 according to the light direction d. In this case, since the light guide 4 has a circular section, the optical profile 41 is a circle with an optical centre 42.

Figure 2:
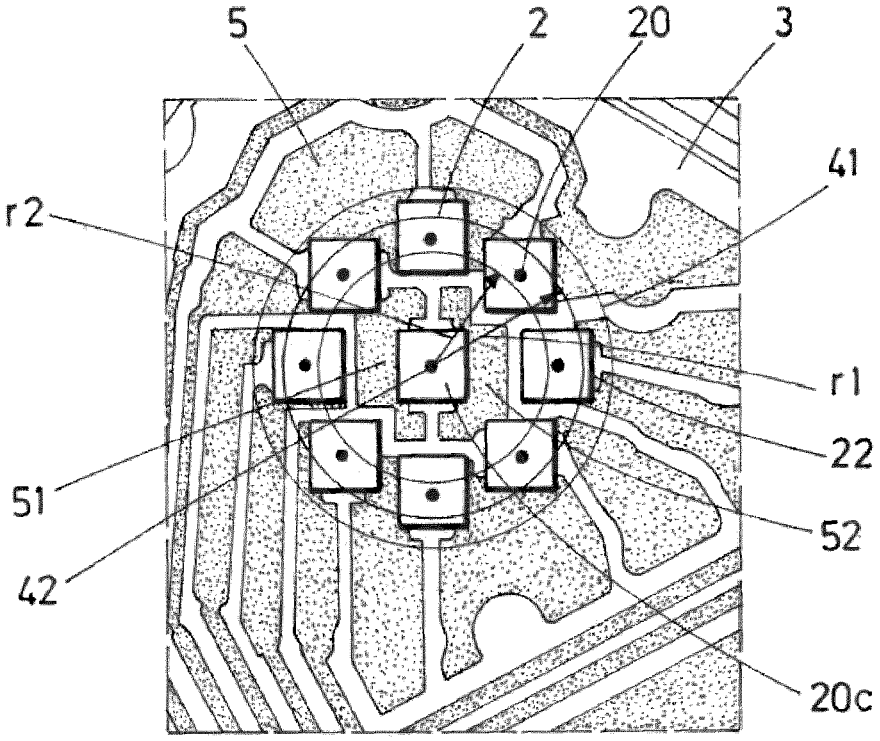
FIG. 2 shows a view of the printed circuit board to show the arrangement of the LEDs with respect to the optical profile.

FIG. 2 shows a view of the printed circuit board 3 to show the arrangement of the LEDs 2 with respect to the optical profile 41.

As may be seen in this figure, 8 out of 9 LED centres 20 are closer to the optical profile 41 than to the optical centre 42. In fact, a circular crown is also represented in this picture, with a greater radius r1 and a lower radius r2, wherein the lower radius r2 is 80% of the greater radius and the greater radius is 80% of the light guide radius r0. As stated before, 8 out of 9 LED centres 20 are inside this circular crown.

In this particular case, the cases of the LEDs 2 have a square profile with a side of 1.6 mm. Since these LEDs are not arranged in a square array, but have an additional distance between them, the distance between any pair of LED centres 20 is at least 2 mm.

Further, these light cases comprise straight sides 22. Although in this embodiment the sides 22 are parallel, in other advantageous embodiments, the sides of the light cases are not parallel, which contributes to create the additional space between them.

Since the LEDs 2 are arranged in a printed circuit board 3, each LED 2 is surrounded by a copper area 5. This copper area is defined as the surface of copper which is in contact with a particular LED.

As may be seen in this figure, each LED 2 is surrounded by a copper area 5. The LEDs which are not surrounded by many other LEDs have a great copper area, so their thermal behaviour is good. However, regarding the LEDs which are surrounded by many other LEDs in the devices from the state of art, the closeness of the rest of the LEDs makes it difficult for the surrounded LED to have a high copper area.

In this case, even the LEDs which are surrounded by many other LEDs have a high copper area, since the rest of the LEDs are far enough to leave the surrounded LED a copper area which is more than 3 times the case surface. In this example, the case surface is 2.56 $mm^2$, since the case is a square with a side of 1.6 mm. The copper area surrounding the central LED 20*c*, which is the LED with the lowest copper area, is 8 $mm^2$, which is far more than the surrounded LEDs present in lighting devices known in the state of the art. In this case, this copper area is divided into two copper area portions 51, 52. This high value of copper area is very important for a good thermal behaviour of the LED.

As a consequence, since all the LEDs 2 are properly cooled by the corresponding copper area, its current value may be increased and therefore, the same flux value may be obtained with a smaller number of LEDs, thus reducing the cost and manufacturing time.

Figure 3:
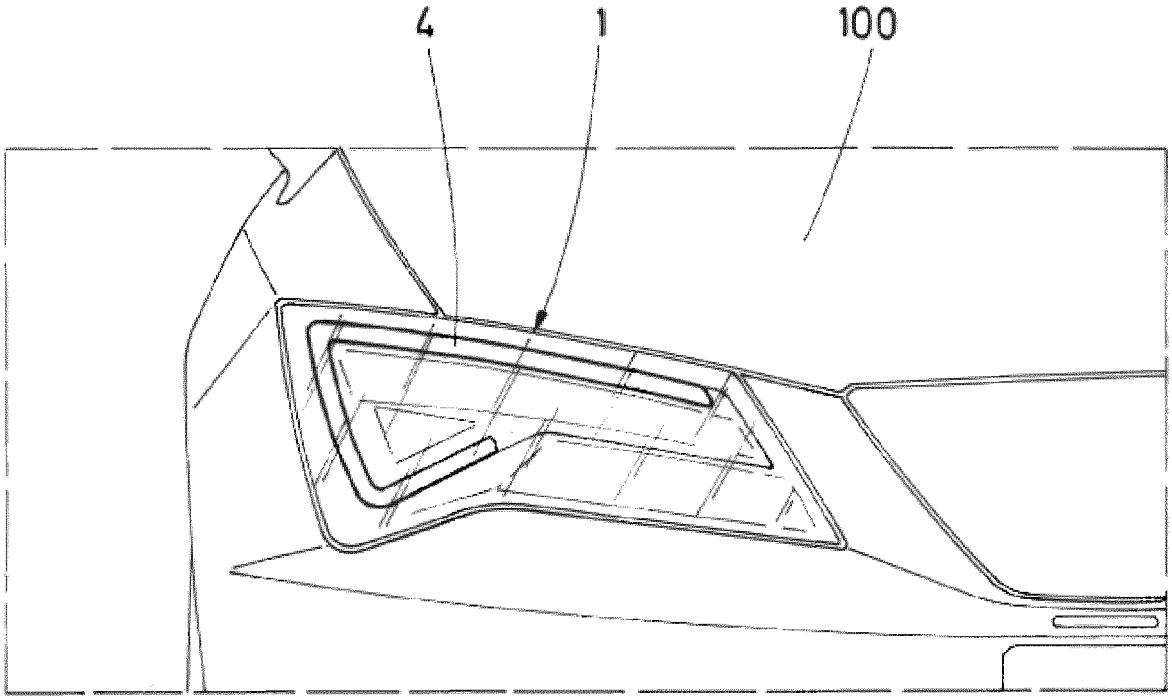
FIG. 3 shows an automotive lighting device according to the invention installed in an automotive vehicle.

FIG. 3 shows an automotive lighting device 1 according to the invention installed in an automotive vehicle 100, wherein the light sources provide light to a light guide 4 to perform both a turning indicator functionality and a day running light functionality.

The invention claimed is:

1. An automotive lighting device comprising a plurality of solid-state light sources configured to emit light according to a light direction, each light source having a light source center and each light source defining a light source plane, which is a plane perpendicular to the light direction which contains the corresponding light source center; and a light guide with a reception inlet which projects an optical profile on a closest light source plane according to the light direction, the optical profile having an optical center;

wherein the light sources are arranged to project light beams to the reception inlet of the light guide in such a way that at least 70% of the light source centers are closer to the optical profile than to the optical center, wherein each light source comprises a case which has a case surface with a side between 1 mm and 3 mm, and wherein each light source is surrounded by a copper area which is greater than 3 times an area of the case surface.

2. The automotive lighting device according to claim 1, wherein at least 80% of the light source centers are closer to the optical profile than to the optical center.

3. The automotive lighting device according to claim 1, wherein the light guide has the shape of a rod, the rod having a first extremity comprising the reception inlet.

4. The automotive lighting device according to claim 1, wherein the light guide is a circular light guide and said optical profile is a circle, a center of which being the optical center.

5. The automotive lighting device according to claim 1, wherein the light guide comprises a circular section defining a light guide radius.

6. The automotive lighting device according to claim 5, wherein at least the 70% of the light source centers are contained in a circular crown defined by a greater radius and a lower radius, the circular crown being inside the profile.

7. The automotive lighting device according to claim 6, wherein the lower radius is at least 80% of the greater radius and the greater radius is at least 80% of the light guide radius.

8. The automotive lighting device according to claim 6, wherein the light sources which have the light source centers thereof contained in the circular crown are arranged such that a shortest distance between closest sides of adjacent light source in the crown is less than a size of sides of the corresponding light source.

9. The automotive lighting device according to claim 1, wherein one of the light sources is central.

10. The automotive lighting device according to claim 1, wherein a distance between two closest light source centers is greater than 1.25 times a square root of the side of the case surface of the light sources comprising the two closest light source centers.

11. The automotive lighting device according to claim 10, wherein the light cases comprise straight sides, and the sides of the light cases of at least one pair of light sources are not parallel.

12. The automotive lighting device according to claim 1, wherein the copper area is divided into several copper area portions.

13. The automotive lighting device according to claim 1, wherein the light sources are located in a plane surface, so that the light source centers are arranged in a same plane.

14. The automotive lighting device according to claim 1, wherein the light sources perform at least one of a turning indicator or a day running light.

15. The automotive lighting device according to claim 2, wherein the light guide has the shape of a rod, the rod having a first extremity comprising the reception inlet.

16. The automotive lighting device according to claim 2, wherein the light guide is a circular light guide and said optical profile is a circle, a center of which being the optical center.

17. The automotive lighting device according to claim wherein the light guide comprises a circular section defining a light guide radius.

18. The automotive lighting device according to claim 17, wherein at least the 70% of the light source centers are contained in a circular crown defined by a greater radius and a lower radius, the circular crown being inside the profile.

19. The automotive lighting device according to claim 18, wherein the light sources which have the light source centers thereof contained in the circular crown are arranged such that a shortest distance closest sides of adjacent light source in the crown is less than a size of the sides of the corresponding light source.

20. The automotive lighting device according to claim 2, wherein a distance between two closest light source centers is greater than 1.25 times a square root of the side of the case surface of the light sources comprising two closest light source centers.

* * * * *